US009340746B1

(12) United States Patent
Henly et al.

(10) Patent No.: US 9,340,746 B1
(45) Date of Patent: May 17, 2016

(54) LOW VISCOSITY TRANSMISSION FLUIDS WITH ENHANCED GEAR FATIGUE AND FRICTIONAL PERFORMANCE

(71) Applicants: Timothy J. Henly, Maidens, VA (US); Joseph B. Carroll, Glen Allen, VA (US); Christopher S. Cleveland, Richmond, VA (US); Kevin M. Strait, Richmond, VA (US); Chintan N. Ved, Canton, MI (US)

(72) Inventors: Timothy J. Henly, Maidens, VA (US); Joseph B. Carroll, Glen Allen, VA (US); Christopher S. Cleveland, Richmond, VA (US); Kevin M. Strait, Richmond, VA (US); Chintan N. Ved, Canton, MI (US)

(73) Assignees: Afton Chemical Corporation, Richmond, VA (US); Ford Motor Company, Dearborn, MI (US)

( * ) Notice: Subject to any disclaimer, the term of this patent is extended or adjusted under 35 U.S.C. 154(b) by 0 days.

(21) Appl. No.: 14/685,011

(22) Filed: Apr. 13, 2015

(51) Int. Cl.
*C10M 133/16* (2006.01)
*C10M 141/10* (2006.01)
*C10M 161/00* (2006.01)

(52) U.S. Cl.
CPC ..... *C10M 161/00* (2013.01)

(58) Field of Classification Search
CPC ..... C10M 2223/04
USPC ..... 508/421
See application file for complete search history.

(56) References Cited

U.S. PATENT DOCUMENTS

| | | | | |
|---|---|---|---|---|
| 2,749,311 | A | 6/1956 | Sabol et al. | |
| 2,760,933 | A | 8/1956 | Fields et al. | |
| 2,765,289 | A | 10/1956 | Fields et al. | |
| 2,850,453 | A | 9/1958 | Fields et al. | |
| 2,910,439 | A | 10/1959 | Fields et al. | |
| 3,663,561 | A | 5/1972 | Blaha et al. | |
| 3,840,549 | A | 10/1974 | Blaha et al. | |
| 3,862,798 | A | 1/1975 | Hopkins | |
| 3,974,081 | A | 8/1976 | Rutkowski et al. | |
| 4,029,587 | A | 6/1977 | Koch | |
| 4,105,571 | A | 8/1978 | Shaub et al. | |
| 4,943,672 | A | 7/1990 | Hammer et al. | |
| 5,137,980 | A | 8/1992 | DeGonia et al. | |
| 5,527,478 | A * | 6/1996 | Romanelli | C10M 159/123 508/348 |
| 5,789,353 | A | 8/1998 | Scattergood | |
| 5,882,505 | A | 3/1999 | Wittenbrink et al. | |
| 6,013,171 | A | 1/2000 | Cook et al. | |
| 6,080,301 | A | 6/2000 | Berlowitz et al. | |
| 6,096,940 | A | 8/2000 | Wittenbrink et al. | |
| 6,103,099 | A | 8/2000 | Wittenbrink et al. | |
| 6,165,949 | A | 12/2000 | Berlowitz et al. | |
| 6,180,575 | B1 | 1/2001 | Nipe | |
| 8,183,187 | B2 | 5/2012 | Sumiejski et al. | |
| 2010/0041572 | A1 * | 2/2010 | Sano | C10M 101/02 508/382 |
| 2012/0053097 | A1 * | 3/2012 | Tagawa | C10M 101/02 508/272 |

* cited by examiner

*Primary Examiner* — Vishal Vasisth
(74) *Attorney, Agent, or Firm* — Mendelsohn Dunleavy, P.C.

(57) ABSTRACT

A lubricant composition, a method for improving lubrication and a method for lubricating a machine. The lubricant composition includes a) a major amount of a base oil having a kinematic viscosity between 2 and 4 cSt at 100° C.; and b) dioctyl phosphite in an amount providing from about 100 to about 1000 ppm phosphorus to the lubricant composition. The lubricant composition has a phosphorus weight ratio of component (b) to total phosphorus in the lubricant composition of from 0.4:1 to less than about 0.8:1.

19 Claims, No Drawings

LOW VISCOSITY TRANSMISSION FLUIDS WITH ENHANCED GEAR FATIGUE AND FRICTIONAL PERFORMANCE

TECHNICAL FIELD

The disclosure relates to the field of additives for use in lubricants and in particular for gear fatigue and frictional performance additives for use in automatic transmission fluids having a low kinematic viscosity.

BACKGROUND AND SUMMARY

Transmission fluid formulations continue to trend to the use of lower viscosities to enhance fuel economy benefits. The benefits of moving to lower viscosity fluids is well-documented; however, the fuel economy benefits realized from a lower viscosity fluid may trade off with gear protection, wear protection, foam and aeration performance, and desired frictional characteristics. One of the requirements of a suitable low viscosity transmission fluid is an ability to pass a Ford Planetary Gear Fatigue Test. Conventional transmission fluid formulations at kinematic viscosity of less than 5 cSt at 100° C. generally cannot achieve a gear fatigue performance of greater than 40 hours. Conventional transmission fluids having kinematic viscosities of 5 cSt or greater at 100° C. may be adequate in terms of gear fatigue performance, but fail to provide suitable fuel economy benefits. The same fluid formulation at a kinematic viscosity of 4.0 cSt at 100° C. may be inadequate for gear fatigue performance. Because driveline system lubricants are moving to lower viscosities to gain overall fuel economy there is a need for lubricating fluids that provide suitable gear fatigue performance and friction performance at a kinematic viscosity below 5 cSt at 100° C.

In view of the above, embodiments of the disclosure provide a lubricant composition, a method for improving lubrication and a method for lubricating a machine. The lubricant composition includes a) a major amount of a base oil having a kinematic viscosity between 2 and 4 cSt at 100° C.; and b) dioctyl phosphite in an amount providing about 100 to about 1000 ppm phosphorus to the lubricant composition. The lubricant composition has a phosphorus weight ratio of component (b) to total phosphorus in the lubricant composition from 0.4:1 to less than about 0.8:1. In one embodiment, the base oil has a kinematic viscosity between 3 and 4 cSt at 100° C.

In one embodiment, the disclosure provides a method for improving the lubricating properties of a lubricating fluid while lubricating an automotive component. The method includes adding a lubricating fluid to an automotive component requiring lubrication, the fluid containing (a) a major amount a base oil having a kinematic viscosity at between 2 and 4 cSt at 100° C., and (b) dioctyl phosphite in an amount providing from about 100 to about 1000 ppm phosphorus to the lubricant composition. The lubricant composition has a phosphorus weight ratio of component (b) to total phosphorus in the lubricant composition of from 0.4:1 to less than about 0.8:1. The automotive component that contains the fluid is operated and exhibits an improved performance relative to the performance of a lubricating fluid free of the compound of 1) (b).

Another embodiment of the disclosure provides a lubricant composition having a kinematic viscosity of less than 5 cSt at 100° C. The lubricant composition includes (a) a major amount of base oil having a kinematic viscosity of from about 2 to about 4 cSt at 100° C., and (b) a dioctyl phosphate component in an amount providing from about 100 to about 1000 ppm phosphorus to the lubricant composition. The lubricant composition has a phosphorus weight ratio of component (b) to total phosphorus in the lubricant composition of from 0.4:1 to less than about 0.8:1 and has a gear fatigue performance of greater than 40 hours.

In one embodiment, component (b) provides from about 100 to about 750 ppm phosphorus to the lubricant composition. In another embodiment, component (b) provides from about 100 to about 600 ppm phosphorus to the lubricant composition. In yet another embodiment, component (b) provides from about 100 to about 550 ppm phosphorus to the lubricant composition, or from about 150 to about 600 ppm phosphorus to the lubricant composition.

In another embodiment a lubricant composition of the disclosure may further include an oil-soluble ashless dispersant selected from: a succinimide dispersant, a succinic ester dispersant, a succinic ester-amide dispersant, a Mannich base dispersant, and phosphorylated and/or boronated forms thereof.

In yet another embodiment of the disclosure, a lubricant composition may further include one or more of the following components selected from: an air expulsion additive, an antioxidant, a corrosion inhibitor, a foam inhibitor, a metallic detergent, an organic phosphorus compound, a seal-swell agent, and a viscosity index improver.

In still another embodiment the disclosure includes a method of lubricating a machine part comprising lubricating the machine part with a lubricant composition containing a minor amount of an additive composition as described herein.

In another embodiment, the disclosure includes a method wherein the machine part is selected from a gear, an axle, a differential, an engine, a pump, a piston, a crankshaft, a transmission, or a clutch.

In another embodiment, the disclosure includes a method wherein the transmission is selected from an automatic transmission, a manual transmission, an automated manual transmission, a semi-automatic transmission, a dual clutch transmission, a continuously variable transmission, and a toroidal transmission.

In one embodiment, the disclosure includes a method wherein the clutch is selected from a continuously slipping torque converter clutch, a slipping torque converter clutch, a lock-up torque converter clutch, a starting clutch, one or more shifting clutches, and an electronically controlled converter clutch.

In another embodiment, the disclosure includes a method wherein the gear is selected from an automotive gear, a stationary gearbox, and an axle.

In another embodiment, the disclosure includes a method wherein the gear is selected from a hypoid gear, a spur gear, a helical gear, a bevel gear, a worm gear, a rack and pinion gear, a planetary gear set, and an involute gear.

In another embodiment, the disclosure includes a method wherein the differential is selected from a straight differential, a turning differential, a limited slip differential, a clutch-type limited slip differential, and a locking differential.

In another embodiment, the disclosure includes a method wherein the engine is selected from an internal combustion engine, a rotary engine, a gas turbine engine, a four-stroke engine, and a two-stroke engine.

In one embodiment, the disclosure includes a method wherein the engine includes a piston, a bearing, a crankshaft, and/or a camshaft.

In another embodiment, the disclosure includes a method wherein the pump is selected from a positive displacement pump, a rotodynamic pump, a reciprocating pump, an impeller pump and/or a centrifugal pump.

In another embodiment, the disclosure includes a method wherein the piston is a hydraulic piston designed to extend, retract, or retract and extend, and/or resist motion.

An advantage of the compositions and methods described herein is that there is provided a lubricant fluid composition that exhibits enhanced gear fatigue properties and suitable friction performance properties in a fluid having a kinematic viscosity of less than 5 cSt at 100° C.

DETAILED DESCRIPTION OF EXEMPLARY EMBODIMENTS

As set forth above, the disclosure provides a lubricant composition that includes a major amount of base oil and a minor amount of an antiwear agent additive.

Base Oil

Base oils suitable for use in formulating transmission fluid compositions may be selected from any of the synthetic or natural oils or mixtures thereof. Natural oils include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale are also suitable. The base oil typically has a kinematic viscosity of from about 2 to about 15 cSt or, as a further example, about 2 to about 10 cSt at 100° C. For low viscosity fluids according to the disclosure, the base oils will typically have a kinematic viscosity ranging from 2 to 4 cSt at 100° C. It should be understood that individual components of the base oil blend may fall outside of the range of 2-4 cSt at 100° C., as long as the kinematic viscosity of the blend falls within that range. Further, an oil derived from a gas-to-liquid process or a biological process is also suitable.

The synthetic base oils include alkyl esters of dicarboxylic acids, polyglycols and alcohols, poly-alpha-olefins, including polybutenes, alkyl benzenes, organic esters of phosphoric acids, and polysilicone oils. Synthetic oils include hydrocarbon oils such as polymerized and interpolymerized olefins (e.g., polybutylenes, polypropylenes, propylene isobutylene copolymers, etc.); poly(l-hexenes), poly-(1-octenes), poly(l-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic oils that may be used. Such oils are exemplified by the oils prepared through polymerization of ethylene oxide or propylene oxide, the alkyl and aryl ethers of these polyoxyalkylene polymers (e.g., methyl-polyisopropylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed $C_{3-8}$ fatty acid esters, or the $C_{13}$ Oxo acid diester of tetraethylene glycol.

Another class of synthetic oils that may be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Hence, the base oil used which may be used to make the lubricating fluid compositions as described herein may be selected from any of the base oils in Groups I-V as specified in the American Petroleum Institute (API) Base Oil Interchangeability Guidelines. Such base oil groups are as follows:

TABLE 1

| Base Oil Group[1] | Sulfur (wt%) | | Saturates (wt%) | Viscosity Index |
|---|---|---|---|---|
| Group I | >0.03 | and/or | <90 | 80 to 120 |
| Group II | ≤0.03 | And | ≥90 | 80 to 120 |
| Group III | ≤0.03 | And | ≥90 | ≥120 |
| Group IV | all polyalphaolefins (PAOs) | | | |
| Group V | all others not included in Groups I-IV | | | |

[1]Groups I-III are mineral oil base stocks.

As set forth above, the base oil may be a poly-alpha-olefin (PAO). Typically, the poly-alpha-olefins are derived from monomers having from about 4 to about 30, or from about 4 to about 20, or from about 6 to about 16 carbon atoms. Examples of useful PAOs include those derived from octene, decene, mixtures thereof, and the like. PAOs may have a viscosity of from about 2 to about 15, or from about 3 to about 12, or from about 4 to about 8 cSt at 100° C. Examples of PAOs include 4 cSt at 100° C. poly-alpha-olefins, 6 cSt at 100° C. poly-alpha-olefins, and mixtures thereof. Mixtures of mineral oil with the foregoing poly-alpha-olefins may be used.

The base oil may be an oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized using processes disclosed in U.S. Pat. No. 6,103,099 or 6,180,575; hydrocracked and hydroisomerized using processes disclosed in U.S. Pat. No. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

Unrefined, refined and rerefined oils, either natural or synthetic (as well as mixtures of two or more of any of these) of the type disclosed hereinabove can be used in the base oils. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives, contaminants, and oil breakdown products.

The base oil may be combined with an additive composition as disclosed in embodiments herein to provide a power transmission fluid. The base oil may be present in the power transmission fluid in an amount from about 50 wt % to about 95 wt %.

Antiwear Agents

Antiwear agents for lubricating fluid for transmissions and gears are typically phosphorus-containing antiwear agents that may include an organic ester of phosphoric acid, phosphorous acid, or an amine salt thereof. For example, the phosphorus-containing antiwear agent may include one or more of a dihydrocarbyl phosphite, a trihydrocarbyl phosphite, a dihydrocarbyl phosphate, a trihydrocarbyl phosphate, any sulfur analogs thereof, and any amine salts thereof. As a further example, the phosphorus-containing antiwear agent may include at least one of dibutyl hydrogen phosphite and an amine salt of sulfurized dibutyl hydrogen phosphite.

However, it has been found, quite surprisingly, that a particular dihydrocarbyl phosphite provides enhanced gear fatigue performance and suitable friction performance in a relatively low viscosity lubricating fluid. Accordingly, embodiments of the disclosure include a minor amount of dioctyl phosphite as the antiwear agent. The dioctyl phosphite is present in an amount that provides from 0 to about 1000 ppm by weight phosphorus to the lubricant composition, for example from about 50 to about 1000 ppm by weight phosphorus, or from about 100 to about 1000 ppm by weight phosphorus, such as from about 200 to about 800 ppm by weight, and desirably from about 300 to about 800 ppm by weight phosphorus based on a total weight of the lubricant composition.

The lubricating fluids described herein may include from about 0.01 wt % to about 1.5 wt % of the phosphorus-containing antiwear agent. As a further example, the lubricating fluids may include from about 0.1 wt % to about 0.8 wt % of the phosphorus-containing antiwear agent. For a non-limiting example, the lubricating fluid may include from about 0.3 wt % to about 1.0 wt % of a dioctyl phosphite.

Optional Additive Components

Lubricating fluids of the disclosure may be formulated optionally with one or more selected ingredients and additives that include, without limitation, those described hereinbelow. Such additives may include, but are not limited to, air expulsion additives, antifoamants (foam inhibitors), antioxidants, anti-rust additives, colorants and tracers, corrosion inhibitors, ashless dispersants, extreme pressure agents, friction modifiers, metal deactivators, metallic detergents, pour point depressants, seal swell agents, and/or viscosity index improvers. Additives are generally described in C. V. Smalheer et al., Lubricant Additives, pages 1-11 (1967) and in U.S. Pat. No. 4,105,571, among others. The supplemental additives include those that are commercially available.

Antifoam Agents

Foam inhibitors (antifoamants) may be selected from silicones, polyacrylates, surfactants, and the like. The amount of antifoam agent in the transmission fluid formulations described herein may range from about 0.01 wt % to about 0.5 wt % based on the total weight of the formulation. As a further example, antifoam agents may be present in an amount from about 0.01 wt % to about 0.1 wt %.

Antioxidants

In some embodiments, antioxidant compounds may be included in the lubricating compositions. Antioxidants include phenolic antioxidants, aromatic amine antioxidants, sulfurized phenolic antioxidants, and organic phosphites, among others. Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-tert-butylphenol), mixed methylene-bridged polyalkyl phenols, and 4,4'-thiobis(2-methyl-6-tert-butylphenol), N,N'-di-sec-butyl-phenylenediamine, 4-isopropylaminodiphenylamine, phenyl-α-naphthyl amine, phenyl-α-naphthyl amine, and ring-alkylated diphenylamines. Examples include the sterically hindered tertiary butylated phenols, bisphenols and cinnamic acid derivatives and combinations thereof. The amount of antioxidant in the lubricating fluid compositions described herein may range from about 0.01 to about 3.0 wt % based on the total weight of the fluid formulation. As a further example, antioxidant may be present in an amount from about 0.1 wt % to about 1.0 wt %.

Ashless Dispersant

The lubricating fluid compositions described herein may contain one or more dispersants, such as an oil-soluble dispersant selected from the group consisting of succinimide dispersants, succinic ester dispersants, succinic ester-amide dispersant, Mannich base dispersant, phosphorylated forms thereof, and boronated forms thereof. The dispersants may be capped with acidic molecules capable of reacting with secondary amino groups. The molecular weight of the hydrocarbyl groups may range from about 600 to about 3000 Dalton, for example from about 750 to about 2500, and as a further example from about 900 to about 1500 Daltons as determined by gel permeation chromatography.

Oil-soluble dispersants may include ashless dispersants such as succinimide dispersants, Mannich base dispersants, and polymeric polyamine dispersants. Hydrocarbyl-substituted succinic acylating agents are used to make hydrocarbyl-substituted succinimides. The hydrocarbyl-substituted succinic acylating agents include, but are not limited to, hydrocarbyl-substituted succinic acids, hydrocarbyl-substituted succinic anhydrides, the hydrocarbyl-substituted succinic acid halides (especially the acid fluorides and acid chlorides), and the esters of the hydrocarbyl-substituted succinic acids and lower alcohols (e.g., those containing up to 7 carbon atoms), that is, hydrocarbyl-substituted compounds which can function as carboxylic acylating agents.

The molecular weight of hydrocarbyl substituent can vary depending upon the intended use of the dispersant. Typically, the dispersant will have a hydrocarbyl group of from about 8 to about 500 carbon atoms. However, lubricating oil soluble dispersants will typically have a hydrocarbyl group of about 40 to about 500 carbon atoms. With high molecular weight dispersants, it is more accurate to refer to number average molecular weight (Mn) since the olefins used to make these dispersants may include a mixture of different molecular weight components resulting from the polymerization of low molecular weight olefin monomers such as ethylene, propylene, and isobutylene.

The mole ratio of maleic anhydride to olefin in the dispersant may vary widely. It may vary, for example, from about 5:1 to about 1:5, or for example, from about 1:1 to about 3:1. With olefins such as polyisobutylene having a number average molecular weight of about 500 to about 7000 Daltons, or as a further example, about 800 to about 3000 Daltons or higher and the ethylene-alpha-olefin copolymers, the maleic anhydride may be used in stoichiometric excess, e.g. about 1.1 to about 3 moles maleic anhydride per mole of olefin. The unreacted maleic anhydride can be vaporized from the resultant reaction mixture.

In some embodiments, the ashless dispersant may include one or more alkenyl succinimides of an amine. Amines which may be employed in forming the ashless dispersant include any that have at least one primary amino group which can react to form an imide group and at least one additional primary or secondary amino group and/or at least one hydroxyl group. Representative examples include: N-methylpropanediamine, N-dodecylpropanediamine, N-aminopropyl-piperazine, ethanolamine, N-ethanol-ethylenediamine, and the like.

Suitable amines may also include alkylene polyamines, such as propylene diamine, dipropylene triamine, di-(1,2-butylene)triamine, and tetra-(1,2-propylene)pentamine. A further example includes the ethylene polyamines which can be depicted by the formula $H_2N(CH_2CH_2NH)_nH$, wherein n may be an integer from about 1 to about 10. Such amines include: ethylene diamine, diethylene triamine (DETA), triethylene tetramine (TETA), tetraethylene pentamine (TEPA), pentaethylene hexamine (PEHA), and the like, including mixtures thereof in which case n is the average value of the mixture. Such ethylene polyamines have a primary amine group at each end so they may form mono-alkenylsuccinimides and bis-alkenylsuccinimides. Commercially available ethylene polyamine mixtures may contain minor amounts of branched species and cyclic species such as N-aminoethyl piperazine, N,N'-bis(aminoethyl)piperazine, N,N'-bis(piperazinyl)ethane, and like compounds. The commercial mixtures may have approximate overall compositions falling in the range corresponding to diethylene triamine to tetraethylene pentamine. The molar ratio of polyalkenyl succinic anhydride to polyalkylene polyamines may be from about 1:1 to about 3.0:1.

The foregoing dispersant may also be a post-treated dispersant made, for example, by treating the dispersant with maleic anhydride and boric acid as described, for example, in U.S. Pat. No. 5,789,353, or by treating the dispersant with nonylphenol, formaldehyde and glycolic acid as described, for example, in U.S. Pat. No. 5,137,980.

The Mannich base dispersants may be a reaction product of an alkyl phenol, typically having a long chain alkyl substituent on the ring, with one or more aliphatic aldehydes containing from about 1 to about 7 carbon atoms (especially formaldehyde and derivatives thereof), and polyamines (especially polyalkylene polyamines). For example, a Mannich base ashless dispersants may be formed by condensing about one molar proportion of long chain hydrocarbon-substituted phenol with from about 1 to about 2.5 moles of formaldehyde and from about 0.5 to about 2 moles of polyalkylene polyamine.

An example of a suitable ashless dispersant is a borated dispersant. Borated dispersants may be formed by boronating (borating) an ashless dispersant having basic nitrogen and/or at least one hydroxyl group in the molecule, such as a succinimide dispersant, succinamide dispersant, succinic ester dispersant, succinic ester-amide dispersant, Mannich base dispersant, or hydrocarbyl amine or polyamine dispersant.

Another example of a dispersant is a phosphorus-containing ashless dispersant. The phosphorylated dispersant may be made by phosphorylating an ashless dispersant having basic nitrogen and/or at least one hydroxyl group in the molecule, such as a succinimide dispersant, succinic ester dispersant, succinic ester-amide dispersant, Mannich base dispersant, hydrocarbyl polyamine dispersant, or polymeric polyamine dispersant. In another embodiment, a phosphorus-containing dispersant may also be boronated (borated).

In one embodiment, the dispersant comprises a phosphorylated dispersant selected from the group consisting of: a succinimide dispersant, a succinic ester dispersant, a succininic ester-amide dispersant, a Mannich base dispersant, and boronated forms thereof. The phosphorylated dispersant may provide from about 100 to about 300 ppm phosphorus to the lubricant composition. Accordingly, a weight ratio of phosphorus provided by the dihydrocarbyl phosphite to the phosphorus provided by the phosphorylated dispersant may range from about 0.4:1 to about 6:1, such as from about 0.5:1 to about 5:1, or from about 0.6:1 to about 3:1.

Corrosion Inhibitors

In some embodiments, copper corrosion inhibitors, sometimes broadly referred to as yellow metals corrosion inhibitors, may constitute another class of additives suitable for inclusion in the compositions described herein. Such compounds include thiazoles, triazoles and thiadiazoles. Examples of such compounds include benzotriazole, tolyltriazole, octyltriazole, decyltriazole, dodecyltriazole, 2-mercapto benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis(hydrocarbyldithio)-1,3,4-thiadiazoles. Suitable compounds include the 1,3,4-thiadiazoles, a number of which are available as articles of commerce, and also combinations of triazoles such as tolyltriazole with a 1,3,5-thiadiazole such as a 2,5-bis(alkyldithio)-1,3,4-thiadiazole. Materials of these types that are available on the open market include COBRATEC TT-100 and HiTEC® 4313 additive (Afton Chemical Corporation). The 1,3,4-thiadiazoles are generally synthesized from hydrazine and carbon disulfide by known procedures. See, for example, U.S. Pat. Nos. 2,765,289; 2,749,311; 2,760,933; 2,850,453; 2,910,439; 3,663,561; 3,862,798; and 3,840,549.

Rust or corrosion inhibitors are another type of inhibitor additive for use in embodiments of the present disclosure. Such materials include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like. Another useful type of rust inhibitor may comprise alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable rust or corrosion inhibitors include ether amines; acid phosphates; amines; polyethoxylated compounds such as ethoxylated amines, ethoxylated phenols, and ethoxylated alcohols; imidazolines; aminosuccinic acids or derivatives thereof, and the like. Materials of these types are available as articles of commerce. Mixtures of such rust or corrosion inhibitors can be used. The amount of corrosion inhibitor in the transmission fluid formulations described herein may range from about 0.01 to about 2.0 wt % based on the total weight of the formulation.

Friction Modifiers

Friction modifiers are used in lubricating fluids to decrease friction between surfaces (e.g., the members of a torque converter clutch or a shifting clutch) at low sliding speeds. The result is a friction-vs.-velocity (μ-v) curve that has a positive slope, which in turn leads to smooth clutch engagements and minimizes "stick-slip" behavior (e.g., shudder, noise, and harsh shifts).

Friction modifiers include such compounds as aliphatic amines or ethoxylated aliphatic amines, ether amines, alkoxylated ether amines, aliphatic fatty acid amides, acylated amines, aliphatic carboxylic acids, aliphatic carboxylic esters, polyol esters, aliphatic carboxylic ester-amides, imidazolines, tertiary amines, aliphatic phosphonates, aliphatic phosphates, aliphatic thiophosphonates, aliphatic thiophosphates, etc., wherein the aliphatic group usually contains one or more carbon atoms so as to render the compound suitably oil soluble. As a further example, the aliphatic group may contain about 8 or more carbon atoms. Also suitable are aliphatic substituted succinimides formed by reacting one or more aliphatic succinic acids or anhydrides with ammonia primary amines.

The succinimide may include the reaction product of a succinic anhydride and ammonia or primary amine. The alkenyl group of the alkenyl succinic acid may be a short chain alkenyl group, for example, the alkenyl group may include from about 12 to about 36 carbon atoms. Further, the succinimide may include a $C_{12}$ to about $C_{36}$ aliphatic hydrocarbyl succinimide. As a further example, the succinimide may include a $C_{16}$ to about $C_{28}$ aliphatic hydrocarbyl succinimide. As an even further example, the succinimide may include a $C_{18}$ to about $C_{24}$ aliphatic hydrocarbyl succinimide.

Metallic Detergents

Certain metallic detergents may optionally be included in the additive package and lubricating fluids of the disclosure. A suitable metallic detergent may include an oil-soluble neutral or overbased salt of alkali or alkaline earth metal with one or more of the following acidic substances (or mixtures thereof): (1) a sulfonic acid, (2) a carboxylic acid, (3) a salicylic acid, (4) an alkyl phenol, (5) a sulfurized alkyl phenol, and (6) an organic phosphorus acid characterized by at least one direct carbon-to-phosphorus linkage. Such an organic phosphorus acid may include those prepared by the treatment of an olefin polymer (e.g., polyisobutylene having a molecular weight of about 1,000) with a phosphorizing agent such as phosphorus trichloride, phosphorus heptasulfide, phosphorus pentasulfide, phosphorus trichloride and sulfur, white phosphorus and a sulfur halide, or phosphorothioic chloride.

Suitable salts may include neutral or overbased salts of magnesium, calcium, or zinc. As a further example, suitable salts may include magnesium sulfonate, calcium sulfonate, zinc sulfonate, magnesium phenate, calcium phenate, and/or zinc phenate. See, e.g., U.S. Pat. No. 6,482,778.

Oil-soluble neutral metal-containing detergents are those detergents that contain stoichiometrically equivalent amounts of metal in relation to the amount of acidic moieties present in the detergent. Thus, in general the neutral detergents will have a low basicity when compared to their overbased counterparts. The acidic materials utilized in forming such detergents include carboxylic acids, salicylic acids, alkylphenols, sulfonic acids, sulfurized alkylphenols and the like.

The term "overbased" in connection with metallic detergents is used to designate metal salts wherein the metal is present in stoichiometrically larger amounts than the organic radical. The commonly employed methods for preparing the overbased salts involve heating a mineral oil solution of an acid with a stoichiometric excess of a metal neutralizing agent such as the metal oxide, hydroxide, carbonate, bicarbonate, or sulfide at a temperature of about 50° C., and filtering the resultant product. The use of a "promoter" in the neutralization step to aid the incorporation of a large excess of metal likewise is known. Examples of compounds useful as the promoter include phenolic substances such as phenol, naphthol, alkyl phenol, thiophenol, sulfurized alkylphenol, and condensation products of formaldehyde with a phenolic substance; alcohols such as methanol, 2-propanol, octanol, ethylene glycol, stearyl alcohol, and cyclohexyl alcohol; and amines such as aniline, phenylene diamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60° C. to 200° C.

Examples of suitable metal-containing detergents include, but are not limited to, neutral and overbased salts such as a sodium sulfonate, a sodium carboxylate, a sodium salicylate, a sodium phenate, a sulfurized sodium phenate, a lithium sulfonate, a lithium carboxylate, a lithium salicylate, a lithium phenate, a sulfurized lithium phenate, a magnesium sulfonate, a magnesium carboxylate, a magnesium salicylate, a magnesium phenate, a sulfurized magnesium phenate, a calcium sulfonate, a calcium carboxylate, a calcium salicylate, a calcium phenate, a sulfurized calcium phenate, a potassium sulfonate, a potassium carboxylate, a potassium salicylate, a potassium phenate, a sulfurized potassium phenate, a zinc sulfonate, a zinc carboxylate, a zinc salicylate, a zinc phenate, and a sulfurized zinc phenate. Further examples include a lithium, sodium, potassium, calcium, and magnesium salt of a hydrolyzed phosphosulfurized olefin having about 10 to about 2,000 carbon atoms or of a hydrolyzed phosphosulfurized alcohol and/or an aliphatic-substituted phenolic compound having about 10 to about 2,000 carbon atoms. Even further examples include a lithium, sodium, potassium, calcium, and magnesium salt of an aliphatic carboxylic acid and an aliphatic substituted cycloaliphatic carboxylic acid and many other similar alkali and alkaline earth metal salts of oil-soluble organic acids. A mixture of a neutral or an overbased salt of two or more different alkali and/or alkaline earth metals can be used. Likewise, a neutral and/or an overbased salt of mixtures of two or more different acids can also be used.

While any effective amount of the metallic detergents may be used to enhance the benefits of this invention, typically these effective amounts will range from about 0.01 to about 0.2 wt. % in the finished fluid, or as a further example, from about 0.05 to about 0.1 wt. % in the finished fluid.

Seal Swell Agents

The seal swell agent used in the lubricating fluid compositions described herein may be selected from oil-soluble diesters, oil-soluble sulfones, and mixtures thereof. Generally speaking the most suitable diesters include the adipates, azelates, and sebacates of $C_8$-$C_{13}$ alkanols (or mixtures thereof), and the phthalates of $C_4$-$C_{13}$ alkanols (or mixtures thereof). Mixtures of two or more different types of diesters (e.g., dialkyl adipates and dialkyl azelates, etc.) can also be used. Examples of such materials include the n-octyl, 2-ethylhexyl, isodecyl, and tridecyl diesters of adipic acid, azelaic acid, and sebacic acid, and the n-butyl, isobutyl, pentyl, hexyl, heptyl, octyl, nonyl, decyl, undecyl, dodecyl, and tridecyl diesters of phthalic acid.

Suitable sulfone seal swell agents are described in U.S. Pat. Nos. 3,974,081 and 4,029,587. Typically these products are employed at levels in the range of about 0.25 wt % to about 5 wt % in the finished fluid. As a further example, they may be provided in an amount of about 0.25 wt % to about 1 wt %.

The seal swell agents may be used in amounts in the range of from about 1 to about 15 wt % in the finished fluid. In the case of the phthalates, the levels in the fluid may fall in the range of from about 1.5 to about 10 wt %. Generally speaking, the higher the molecular weight of the adipate, sebacate or phthalate, the higher should be the treat rate within the foregoing ranges.

Viscosity Index Improvers

Viscosity index improvers for use in the above described fluids and lubricant compositions may be selected from polyisoalkylene compounds, polymethacrylate compounds, and any conventional viscosity index improvers. An example of a suitable polyisoalkylene compound for use as a viscosity index improver includes polyisobutylene having a weight average molecular weight ranging from about 700 to about 2,500 Daltons. Embodiments may include a mixture of one or more viscosity index improvers of the same or different molecular weight.

In selecting any of the optional additives, it may be important to ensure that the selected component(s) may be soluble or stably dispersible in the additive package and the finished lubricant composition, and may be compatible with the other components of the composition. By preference, a person skilled in the art may be expected to choose an additional optional additive or combination of additives, amounts thereof, such that the performance properties of the composition, such as the improved low temperature viscometrics, among other properties, needed or desired, as applicable, in the overall finished composition, may not be substantially adversely affected.

In general, the ancillary additive components may be employed in the lubricating oil in minor amounts sufficient to improve the performance characteristics and properties of the base fluid. The amounts may thus vary in accordance with such factors as the viscosity characteristics of the base fluid employed, the viscosity characteristics desired in the finished fluid, the service conditions for which the finished fluid is intended, and the performance characteristics desired in the finished fluid.

However, generally speaking, the following general concentrations (weight percent unless otherwise indicated) of the additional components in the base fluids may be illustrative. The amounts below are given in weight % of the fully formulated lubricating fluid.

TABLE 2

| Component | Wt. % (Broad) | Wt. % (Typical) |
|---|---|---|
| Dispersant additive | 0.5-20.0 | 1.0-15.0 |
| Antioxidants | 0-2.0 | 0.01-1.0 |
| Metal Detergents | 0.1-10.0 | 0.5-5.0 |
| Corrosion Inhibitor | 0-5.0 | 0-2.0 |
| Extreme pressure/antiwear agents | 0.01-5.0 | 0.1-2.0 |
| Antifoaming agents | 0-1.0 | 0.001-0.1 |
| Pour point depressant | 0.001-1.0 | 0.01-0.5 |
| Friction modifiers | 0-2.0 | 0.05-1.0 |

TABLE 2-continued

| Component | Wt. % (Broad) | Wt. % (Typical) |
|---|---|---|
| Seal swell agents | 0-10.0 | 0.5-5.0 |
| Viscosity index improvers | 0-30 | 5.0-15 |
| Base oil | Balance | Balance |
| Total | 100 | 100 |

It will be appreciated that the individual components employed may be separately blended into the base fluid or may be blended therein in various sub-combinations, if desired. Ordinarily, the particular sequence of such blending steps is not crucial. Moreover, such components may be blended in the form of separate solutions in a diluent. It may be preferable, however, to blend the additive components used in the form of a concentrate, as this simplifies the blending operations, reduces the likelihood of blending errors, and takes advantage of the compatibility and solubility characteristics afforded by the overall concentrate.

Additive concentrates may thus be formulated to contain all of the additive components and if desired, some of the base oil component, in amounts proportioned to yield finished fluid blends consistent with the concentrations described above. In most cases, the additive concentrate will contain one or more diluents such as light mineral oils, to facilitate handling and blending of the concentrate. Thus concentrates containing up to about 50 wt. % of one or more diluents or solvents may be used, provided the solvents are not present in amounts that interfere with the low and high temperature and flash point characteristics and the performance of the finished power transmission fluid composition. In this regard, the additive components used pursuant to this disclosure may be selected and proportioned such that an additive concentrate or package formulated from such components will have a flash point of about 170° C. or above, using the ASTM D-92 test procedure.

Lubricating fluids of the embodiments herein may be formulated to provide lubrication and/or enhanced friction performance properties and/or improved low temperature viscometric properties for various applications. For example, fluid composition of the disclosure may be suitable for automatic or manual transmissions, including step automatic transmissions, continuously variable transmissions, semi-automatic transmissions, automated manual transmissions, toroidal transmissions, and dual clutch transmissions. Such transmissions include four-, five-, six-, and seven-speed transmissions, and continuously variable transmissions (chain, belt, or disk type). Further, the lubricating fluids of the present disclosure may also be suitable for use in transmissions with an electronically controlled converter clutch, a slipping torque converter, a continuously slipping torque converter clutch, a lock-up torque converter, a starting clutch, and/or one or more shifting clutches. Lubricating fluids according to the present disclosure may also be used in gear applications, such as industrial gear applications, automotive gear applications, axles, and stationary gearboxes. Gear-types may include, but are not limited to, spur, spiral, worm, rack and pinion, involute, bevel, helical, planetary, and hypoid gears. The presently disclosed lubricating fluids may be used in axles, transfer cases, differentials, such as straight differentials, turning differentials, limited slip differentials, clutch-type differentials, and locking differentials, and the like. Lubricating fluids of the present disclosure may be used in various engine applications, including but not limited to, internal combustion engines, rotary engines, gas turbine engines, four-stroke engines, and two-stroke engines. Engine components that may be lubricated with presently disclosed additives may include pistons, bearings, crankshafts, and/or camshafts. Lubricating fluids of the present disclosure may also be used in systems of mechanical pumps and hydraulic pistons where the aforementioned clutch(es), gears and engines may be absent. Further, they may also be useful in metalworking applications. A further aspect of the present disclosure may provide lubricant composition comprising a lubricant additive as described herein, wherein the lubricant composition is suitable for lubricating moving components or parts of a truck, an automobile, and/or a piece of mechanized farm equipment, such as a tractor or reaper.

An example of exemplary embodiments of the disclosure and certain comparative examples are provided below. All the examples were tested for gear fatigue and friction performance using a low viscosity Group III mineral base oil. However, other low viscosity base oils could have been used including base oils from Groups I, II and IV.

EXAMPLES

The following non-limiting examples are provided in order to further illustrate the features and advantages of one or more embodiments of the disclosure. All of the fluids tested in the following table included the components as shown in the Table in order to provide a fully-formulated lubricating fluid composition.

Examples 1-5 are finished automatic transmission fluids containing identical additive packages, using typical automatic transmission fluid componentry, e.g., dispersant, detergent, friction modifiers, antioxidants, etc. All the Examples were blended at similar treat rates into different viscosity grade Group III mineral oils necessary to achieve a given finished fluid kinematic viscosity at 100° C. The major difference in the Examples was the resulting finished fluid kinematic viscosity at 100° C. Example 6 is similar to Example 1 except that a different dispersant was used in the formulation resulting in a need for a higher viscosity base oil blend to achieve the finished fluid kinematic viscosity target of 4.5 cSt. at 100° C. Examples 1-6 span a range of finished fluid kinematic viscosities of from 4.54 to 3.25 cSt at 100° C. The major difference between the Examples and Comparative Examples arises from the concentration and the chemical structure of phosphite anti-wear used in the finished fluid.

Example 1

Example 1 is a finished automatic transmission fluid with a kinematic viscosity of 4.54 cSt at 100° C. Example 1 contains a total of 746 ppm of phosphorus wherein 531 ppm of phosphorus has been introduced by the addition of dioctyl phosphite and the balance a result of the dispersant used.

Example 2

Example 2 is a finished automatic transmission fluid with a kinematic viscosity of 4.07 cSt at 100° C. Example 2 contains a total of 756 ppm of phosphorus wherein 541 ppm of phosphorus has been introduced by the addition of dioctyl phosphite and the balance a result of the dispersant used.

Example 3

Example 3 is a finished automatic transmission fluid with a kinematic viscosity of 3.73 cSt at 100° C. Example 3 contains a total of 753 ppm of phosphorus wherein 538 ppm of phosphorus has been introduced by the addition of dioctyl phosphite and the balance a result of the dispersant used.

Example 4

Example 4 is a finished automatic transmission fluid with a kinematic viscosity of 3.46 cSt at 100° C. Example 4 contains a total of 751 ppm of phosphorus wherein 536 ppm of phosphorus has been introduced by the addition of dioctyl phosphite and the balance a result of the dispersant used.

Example 5

Example 5 is a finished automatic transmission fluid with a kinematic viscosity of 3.25 cSt at 100° C. Example 5 contains a total of 759 ppm of phosphorus wherein 544 ppm of phosphorus has been introduced by the addition of dioctyl phosphite and the balance a result of the dispersant used.

Example 6

Example 6 is a finished automatic transmission fluid with a kinematic viscosity of 4.53 cSt at 100° C. Example 6 contains a total of 374 ppm of phosphorus wherein 180 ppm of phosphorus has been introduced by the addition of dioctyl phosphite and the balance a result of the dispersant used. Again, Example 6 is similar to Example 1 except that a different dispersant was used in the formulation resulting in a need for a higher viscosity base oil blend to achieve the finished fluid kinematic viscosity target of 4.5 cSt. at 100° C.

Comparative Example 1

Comparative Example 1 is a finished automatic transmission fluid with a kinematic viscosity of 4.50 cSt at 100° C. Comparative Example 1 contains a total of 1306 ppm of phosphorus wherein 1091 ppm of phosphorus has been introduced by the addition of dioctyl phosphite and the balance a result of the dispersant used.

Comparative Example 2

Comparative Example 2 is a finished automatic transmission fluid with a kinematic viscosity of 4.53 cSt at 100° C. Comparative Example 2 contains a total of 755 ppm of phosphorus wherein 540 ppm of phosphorus has been introduced by the addition of dioleyl phosphite and the balance a result of the dispersant used.

Comparative Example 3

Comparative Example 3 is a finished automatic transmission fluid with a kinematic viscosity of 5.98 cSt at 100° C. Comparative Example 4 contains a total of 215 ppm of phosphorus wherein 0 ppm of phosphorus has been introduced by the addition of any phosphite and the balance a result of the dispersant used.

Comparative Example 4

Comparative Example 4 is a finished automatic transmission fluid with a kinematic viscosity of 4.01 cSt at 100° C. Comparative Example 4 contains a total of 207 ppm of phosphorus wherein 0 ppm of phosphorus has been introduced by the addition of any phosphite and the balance a result of the dispersant used.

TABLE 3

| Examples | Transmission Fluid KV (100° C.) | Base oil KV (100° C.) | Total P (ppm) | Phosphite | P from phosphite (ppm) | Gear Fatigue (hr: min) | Friction Testing (D530-31), Static Break-away, $\mu_s$ at 200 cycles | Midpoint Dynamic Friction, $\mu_d$, (after 30,000 cycles, MERCON 30K on D530-31 plates) | Stop time (after 30,000 cycles, MERCON 30K on D530-31 plates) |
|---|---|---|---|---|---|---|---|---|---|
| Target | | | | | | >40:00 | 0.109-0.120 | 0.14-0.16 | <0.85 sec |
| Example 1 | 4.54 | 3.17 | 746 | Dioctyl | 531 | 63:13 | 0.113 | 0.149 | 0.819 |
| Example 2 | 4.07 | 2.80 | 756 | Dioctyl | 541 | 49:34 | — | — | — |
| Example 3 | 3.73 | 2.62 | 753 | Dioctyl | 538 | 45:04 | — | — | — |
| Example 4 | 3.46 | 2.40 | 751 | Dioctyl | 536 | 42:39 | — | — | — |
| Example 5 | 3.25 | 2.27 | 759 | Dioctyl | 544 | 42:52 | — | — | — |
| Example 6 | 4.53 | 3.17 | 374 | Dioctyl | 180 | 45:58 | — | — | — |
| Comparative 1 | 4.50 | 3.92 | 1306 | Dioctyl | 1091 | — | — | 0.132 | 0.880 |
| Comparative 2 | 4.53 | 3.17 | 755 | Dioleyl | 540 | — | 0.105 | — | — |
| Comparative 3 | 5.98 | 4.01 | 215 | none | 0 | 59:01 | 0.122 | 0.146 | 0.808 |
| Comparative 4 | 4.01 | 3.17 | 207 | none | 0 | 27:44 | — | — | — |

MERCON® Friction Testing is described in the Ford Motor Company MERCON® V specification revised and effective Jul. 1, 2004 for an Automatic Transmission Fluid. The procedure for MERCON® Friction Testing is described in Section 3.12, pages 8-13, under the title Clutch Friction Durability (CFD). The MERCON® CFD Testing detailed in the Table 3 was conducted using friction material type 530-31 from Dynax Corporation and recommended steel plates detailed in the procedure.

In Ford's CFD testing, generally better results are obtained when the Static Breakaway friction (which is an indicator of a fluid/hardware combination's torque capacity) at around 200 cycles of CFD testing is between 0.109-0.120. Initial Static Breakaway friction at 200 cycles below 0.109 can lead to slipping clutches, increased temperatures at the clutch interfaces, damaging of the clutch plates, friction material glazing, and loss of torque capacity. Also, generally better results are obtained when the Midpoint Dynamic friction at the end of the 30,000 durability cycle test is between 0.140 and 0.160. Midpoint Dynamic friction at the end of the 30,000 durability cycle test below 0.140 is an indication of potentially a poor friction durability fluid in use, preliminary signs of slipping clutches, increased temperatures at the clutch interfaces, damaging of clutch plates, friction material glazing, and loss of torque capacity. Finally, generally better results are obtained when the Stop Times at the end of the 30,000 durability cycle test are less than 0.85 sec. Stop Times at the end of the 30,000 durability cycle test which are greater than 0.85 sec indicate that potentially a poor friction durability fluid in use, preliminary signs of slipping clutches, increased temperatures at the clutch interfaces, damaging of clutch plates, friction material glazing, and loss of torque capacity.

Gear Fatigue Testing refers to a Ford 4R75W Transmission Low Gear Fatigue Test. One procedure for the Ford 4R75W Low Gear Fatigue Test is described in U.S. Pat. No. 8,183,187 B2; however, the procedure described herein is quite different. The Ford 4R75W Low Gear Fatigue Test, used in the tests described herein, is a steady state test employing a 521 cubic inch V-8 engine with a dynamometer calibrated controller. The test has two phases, the first phase (Stage 1) of the test is run with the transmission in second gear passing 821 lb*ft (about 39 kPa) of torque at 750 rpm output shaft speed for 35 hours or until failure. The second phase (Stage 2) of the test is run consecutively with the transmission in first gear passing 1500 lb*ft (about 72 kPa) of torque at 450 rpm output shaft speed until failure. A solid-state accelerometer is attached to the transmission's outer case. For the first 10 minutes of Stage 1 and Stage 2 the acceleration readings are root mean square (RMS) averaged over a 10 minute window to establish a baseline. Within each stage, an acceleration event exceeding 1.4 times this baseline (140%) is the indicator for test failure. Fluid temperature is controlled as follows: case-out temperature=250° F. (about 121° C.) and case-in temperature=170° F. (about 77° C.). Typically, the test reports hours to failure for each automatic transmission fluid tested. Generally, a passing result is obtained if a sample's hours to failure are comparable to the hours to failure of the reference fluid. The reference fluid in this case is the factory fluid required for the Ford 4R75W transmission and a passing result is obtained if a sample runs between 40 and 50 hours before failure. Less than 40 hours to failure in the Ford 4R75W Transmission Low Gear Fatigue Test is an indication of insufficient wear protection exhibited from the lubricant. Greater than 50 hours to failure in the Ford 4R75W Transmission Low Gear Fatigue Test is an indication of exceptional wear protection exhibited from the lubricant.

ATFs containing the elements of the present invention meet the requirements for gear protection, friction level, and friction durability.

At numerous places throughout this specification, reference has been made to a number of U.S. Patents, European Patent Applications (published), PCT International patent publications, and literature references. All such cited documents are expressly incorporated in full into this disclosure as if fully set forth herein.

While the present disclosure has been principally demonstrated hereinabove in the examples as a power transmitting fluid or powertrain lubricant having improved low temperature viscometrics for transmissions, it is contemplated that the benefits of the fluid embodiment are similarly applicable to other lubricating or power transmitting fluids. Included within the scope of the present disclosure may be, but not limited to, gear oils, hydraulic fluids, engine oils, heavy duty hydraulic fluids, industrial oils, power steering fluids, pump oils, tractor fluids, and universal tractor fluids. Apparatus embodiments may include, but are not limited to, gears, engines, hydraulic mechanisms, power steering devices, pumps and the like incorporating a lubricating fluid according to the present disclosure.

Other embodiments of the present disclosure will be apparent to those skilled in the art from consideration of the specification and practice of the embodiments disclosed and suggested herein. It is intended that the specification and examples be considered as exemplary only, with a true scope and spirit of the disclosure being indicated by the following claims.

As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

What is claimed is:

1. A lubricant composition comprising:

a) a major amount of a base oil having a kinematic viscosity between 2 and 4 cSt at 100° C.;

b) dioctyl phosphite in an amount providing from about 150 to about 600 ppm phosphorus to the lubricant composition;

a phosphorylated dispersant comprising a phosphorylated polyisobutenyl bis-succinimide dispersant, wherein the dispersant provides from about 100 to about 300 ppm phosphorus to the lubricant composition; and wherein the lubricant composition has a phosphorus weight ratio of component (b) to total phosphorus in the lubricant composition of from 0.4:1 to less than about 0.8:1.

2. The lubricant composition of claim 1, wherein component (b) provides from about 150 to about 550 ppm phosphorus to the lubricant composition.

3. The lubricant composition of claim 1, wherein the weight ratio of phosphorus provided by component (b) to the phosphorus provided by the phosphorylated dispersant ranges from about 0.4:1 to about 6:1.

4. The lubricant composition of claim 1, wherein component (a) has a kinematic viscosity between 3 and 4 cSt at 100° C.

5. The lubricant composition of claim 1, further comprising one or more of the following: an air expulsion additive, an antioxidant, a corrosion inhibitor, a foam inhibitor, a metallic detergent, an organic phosphorus compound, a seal-swell agent, and a viscosity index improver.

6. A method of lubricating a machine part comprising lubricating said machine part with the lubricant composition of claim 1.

7. The method of claim 6, wherein said machine part comprises a gear, an axle, a differential, an engine, a crankshaft, a pump, a hydraulic piston, a transmission, or a clutch.

8. The method of claim 7, wherein said transmission is selected from the group consisting of an automatic transmission, a manual transmission, an automated manual transmission, a semi-automatic transmission, a dual clutch transmission, a continuously variable transmission, and a toroidal transmission.

9. The method of claim 7, wherein said clutch comprises a continuously slipping torque converter clutch, a slipping torque converter clutch, a lock-up torque converter clutch, a starting clutch, one or more shifting clutches, or an electronically controlled converter clutch.

10. A method for improving the lubricating properties of a lubricating fluid while lubricating an automotive component requiring lubrication, comprising:

1) adding a lubricating fluid to an automotive component requiring lubrication, said fluid comprising (a) a major amount a base oil having a kinematic viscosity ranging from about 2 to about 4 cSt at 100° C., and (b) dioctyl phosphite in an amount providing from about 150 to about 600 ppm phosphorus to the lubricant composition, a phosphorylated dispersant comprising a phosphorylated polyisobutenyl bis-succinimide dispersant, wherein the dispersant provides from about 100 to about 300 ppm phosphorus to the lubricant composition, and wherein the lubricant composition has a phosphorus weight ratio of component (b) to total phosphorus in the lubricant composition of from 0.4:1 to less than about 0.8:1, 2) operating the automotive component that contains the fluid, wherein the fluid exhibits improved lubrication performance relative to the performance of a lubricating fluid free of the compound of 1) (b).

11. The method of claim 10, wherein the weight ratio of phosphorus provided by component (b) to the phosphorus provided by the phosphorylated dispersant ranges from about 0.4:1 to about 6:1.

12. A lubricant composition having a kinematic viscosity of less than 5 cSt at 100° C. comprising, (a) a major amount of base oil having a kinematic viscosity of from about 2 to less than about 4 cSt at 100° C., and (b) dioctyl phosphite in an amount providing from about 150 to about 600 ppm phosphorus to the lubricant composition, a phosphorylated dispersant comprising a phosphorylated polyisobutenyl bis-succinimide dispersant, wherein the dispersant provides from about 100 to about 300 ppm phosphorus to the lubricant composition, and wherein the lubricant composition has a phosphorus weight ratio of component (b) to total phosphorus in the lubricant composition of from 0.4:1 to less than about 0.8:1, wherein the lubricant composition has a gear fatigue performance of greater than 40 hours.

13. The lubricant composition of claim 12, wherein the lubricant composition has a kinematic viscosity between 4.0 and 4.6 cSt at 100° C.

14. The lubricant composition of claim 12, wherein the lubricant composition has a static breakaway coefficient of friction at 200 cycles in the Ford Clutch Friction Durability Test of from 0.109 to 0.119.

15. The lubricant composition of claim 12, wherein the lubricant composition has a midpoint dynamic coefficient of friction after 30,000 cycles in the Ford Clutch Friction Durability Test of from 0.14 to 0.16.

16. The lubricant composition of claim 12, wherein the lubricant composition has a stop time after 30,000 cycles in the Ford Clutch Friction Durability Test of less than 0.85 seconds.

17. A method of improving gear fatigue protection while maintaining friction control for an automatic transmission using low viscosity automatic transmission fluid by using an effective amount of a lubricating oil composition comprising or being made by admixing: (1) a major amount of a base oil; and (2) a gear fatigue improving effective amount of an additive combination comprising: (a) dioctyl phosphite in an amount providing from about 150 to about 600 ppm phosphorus to the lubricant composition; (b) a phosphorylated dispersant comprising a phosphorylated polyisobutenyl bis-succinimide dispersant, wherein the dispersant provides from about 100 to about 300 ppm phosphorus to the lubricant composition; wherein the lubricant composition has a phosphorus weight ratio of dioctyl phosphite to total phosphorus in the lubricant composition of from 0.4:1 to less than about 0.8:1, and wherein the lubricating composition has a kinematic viscosity of between 2 and 5 cSt at 100° C.

18. The method of claim 17 wherein the lubricating composition has a kinematic viscosity of between 2 and 4.6 cSt at 100° C.

19. The method of claim 17 wherein the lubricating composition has a kinematic viscosity of between 4.0 and 4.6 cSt at 100° C.

* * * * *